US008025091B2

(12) United States Patent
Kennelly

(10) Patent No.: US 8,025,091 B2
(45) Date of Patent: Sep. 27, 2011

(54) OPENING PROTECTION

(75) Inventor: Bernard Joseph Kennelly, North Balgowlah (AU)

(73) Assignee: ITW Australia Pty Ltd, Victoria (AU)

( * ) Notice: Subject to any disclaimer, the term of this patent is extended or adjusted under 35 U.S.C. 154(b) by 221 days.

(21) Appl. No.: 11/949,725

(22) Filed: Dec. 3, 2007

(65) Prior Publication Data

US 2008/0142168 A1 Jun. 19, 2008

(30) Foreign Application Priority Data

Dec. 4, 2006 (AU) ..... 2006906775

(51) Int. Cl.
*E06B 3/80* (2006.01)

(52) U.S. Cl. ..... 160/327; 160/368.1

(58) Field of Classification Search ..... 160/371, 160/368.1, 327, DIG. 15, 404, 383; 52/202, 52/DIG. 12, 449, 741.3, 63; 256/DIG. 6, 256/65.1, 23, 45, 24; 182/113, 112, 138, 182/129, 139

See application file for complete search history.

(56) References Cited

U.S. PATENT DOCUMENTS

| | | | | | |
|---|---|---|---|---|---|
| 2,605,828 | A | * | 8/1952 | Lang | 160/328 |
| 2,646,117 | A | * | 7/1953 | Hodgins | 160/368.1 |
| 3,480,069 | A | * | 11/1969 | Handwerker | 160/354 |
| 4,815,562 | A | * | 3/1989 | Denny et al. | 182/138 |
| 4,852,194 | A | * | 8/1989 | Langan | 5/427 |
| 4,968,366 | A | * | 11/1990 | Hukki et al. | 156/153 |
| 5,038,889 | A | | 8/1991 | Jankowski | |
| 5,161,641 | A | * | 11/1992 | Nusbaum | 182/138 |
| 5,197,239 | A | * | 3/1993 | Glynn et al. | 52/63 |
| 5,201,497 | A | * | 4/1993 | Williams et al. | 256/12.5 |
| 5,406,764 | A | * | 4/1995 | Van Auken et al. | 52/408 |
| 6,098,750 | A | * | 8/2000 | Reynolds et al. | 182/138 |
| 6,279,644 | B1 | * | 8/2001 | Wylie | 160/371 |
| 6,305,310 | B1 | * | 10/2001 | Ferri | 114/343 |
| 6,462,990 | B1 | * | 10/2002 | Keeney | 365/185.29 |
| 6,619,003 | B2 | * | 9/2003 | Von Arx et al. | 52/222 |
| 6,758,306 | B2 | * | 7/2004 | Walls et al. | 182/138 |
| 7,191,907 | B2 | * | 3/2007 | Conway | 211/180 |
| 7,753,101 | B2 | * | 7/2010 | Johnson | 160/368.1 |
| 2008/0142168 | A1 | * | 6/2008 | Kennelly | 160/127 |

FOREIGN PATENT DOCUMENTS

| | | | |
|---|---|---|---|
| DE | 2701138 | A1 | 7/1978 |
| DE | 3842435 | C1 | 7/1990 |
| EP | 1052345 | A1 | 11/2000 |
| WO | 03036001 | A2 | 5/2003 |

OTHER PUBLICATIONS

European Search Report of Patent Application No. GB0723570.8 mailed Feb. 14, 2008.

* cited by examiner

*Primary Examiner* — Blair M. Johnson
(74) *Attorney, Agent, or Firm* — Lowe Hauptman Ham & Berner, LLP

(57) ABSTRACT

A temporary protection for an opening in a frame of a building component includes flexible sheet material spanning the opening between opposite sides thereof. Each end portion of the sheet material is connected to a frame member at a respective side of the opening, the flexible sheet material being of an open structure and the connection with the frame member being by adhesive which permeates the material from one side to the other. The connection of the sheet material to the frame members is such as to resist loading applied by an adult person acting against the sheet material. The sheet material can be cut by a sharp blade for subsequent removal of the temporary protection from the opening when no longer required.

6 Claims, 2 Drawing Sheets

OPENING PROTECTION

RELATED APPLICATIONS

The present application is based on, and claims priority from, Australia Application Number 2006-906775, filed Dec. 4, 2006, the disclosure of which is hereby incorporated by reference herein in its entirety.

BACKGROUND OF THE INVENTION

1) Field of the Invention

The present invention relates to a system for providing temporary protection in openings which may be present such as in walls during a phase of building construction so as to form a barrier within the opening.

2) Description of the Prior Art

Operational regulations applicable to the construction of timber framed domestic dwellings require openings in an upper level wall frame of a two story building to be protected against workpersons accidentally falling through an opening onto the ground below. Openings which are the subject of such regulations include openings for windows and doors and which are present in wall frames before the actual window or door structure is fitted. While the regulations can be met by the use of scaffolding installed around the outside of the building, or reusable screens or netting, these are relatively expensive to install. An alternative option has been to fasten strong board to the outside of the flame over the opening, boards of fiberboard or plywood for example, but this is also relatively expensive and requires the use of a strong connection into the frame to resist a high pull-out load which is applied should a person fall against the board from the inside of the building; although the problem of pull-out loads can be resolved by fastening the board to the inside face of the frame around the opening, this is not a practical option as the presence of the board internally impedes the application of plasterboard and other components needed prior to the installation particularly of windows.

SUMMARY OF THE INVENTION

According to the present invention there is provided a temporary protection for an opening in a building component, the protection comprising flexible sheet material spanning the opening between opposite sides thereof, each end portion of the sheet material being connected to a member at a respective side of the opening with the material extending from its connection to pass across the opening via passage around at least one corner of the member and across a face of the member parallel to the plane of the opening such that the connection is able to resist loading applied by an adult person acting against the sheet material from the side of the said one face.

Further according to the present invention there is provided a temporary protection for an opening in a building component, the protection comprising flexible sheet material spanning the opening between opposite sides thereof, each end portion of the sheet material being connected to a member at a respective side of the opening and passing across the opening via passage around at least one corner of the member whereby when the sheet material is subject to a tensile loading by a person falling against the sheet material, the sheet material will be applied tightly against the corner to distribute and reduce the loading applied to the connection between the material and the member.

The sheet material may be applied horizontally across the opening between opposed vertical studs or vertically across the opening between opposed upper and lower horizontal frame members.

It is particularly preferred that the sheet material is adhesively secured to the members with the adhesive extending across the entire width of the material to ensure load distribution across the entire width of the material in a relatively uniform manner rather than at a series of spaced points.

The material is preferably in the form of a fabric with a relatively open weave, a perforate sheet material, or a mesh-type material equivalent to that used in insect screens to permit the adhesive to permeate through the material from one side to the other. The material is such that when the temporary protection is no longer required it can be removed simply by cutting with a sharp blade.

BRIEF DESCRIPTION OF THE DRAWINGS

An embodiment of the invention will now be described by way of example only with reference to the accompanying drawings in which.

DESCRIPTION OF THE PREFERRED EMBODIMENTS

In accordance with a preferred embodiment of the invention, protection is provided for an opening in a wall frame by applying strong, flexible, sheet material 2 across the inside face of the opening 3, preferably between studs 4 at each vertical side of the opening so that the material spans the opening horizontally. Although it is to be understood that in some circumstances the material may alternatively extend vertically along the opening between parts of the frame adjacent the upper and lower ends of the opening, the preferred embodiment of the invention will be described in relation to the application of the material so that it horizontally spans the studs at each vertical side of the opening. The material is secured to each stud 4 by adhesive attachment to its side face which is furthest from the opening, in other words its outer side face at right angles to the inner face of the stud; accordingly the sheet material extends from the outer side face, across the inner face of the stud and across the opening itself by passage across the corner of the stud at the junction between its outer side face and inner face. The material 2 is glued to the stud 4 along the entire length of the vertical span of the material which, in practice, is likely to be the width direction of the material. Although the material 2 may extend the full height of the opening 3, this is not be essential as in most situations adequate protection may be obtained with the material spanning only part of the height of the opening.

It will be understood that the material itself must have a sufficient inherent strength to withstand the weight of an adult person falling into the material, such as by accidentally stepping backwards or tripping, and also the glued connection between the material and the studs must be sufficient to withstand those forces. Although solid flexible plastics sheeting of suitable thickness is likely to have sufficient inherent strength for the purpose it is also necessary to ensure its satisfactory adhesive connection to the stud. With the fixing arrangement described in which the material is adhered to the outer side face of the stud and passes around the outer corner at the inner face of the stud, when the material is subject to an impact loading such as may be induced by a person tripping against it, the interaction between the sheet material and that corner will create frictional forces which dissipate the loading to an extent and also tend to distribute the loading somewhat along the width direction of the material so that the loading would in practice be carried by the adhesive connection over a relatively large area, but care needs to be taken to ensure that the adhesive connection is properly and adequately made.

Figure 1:
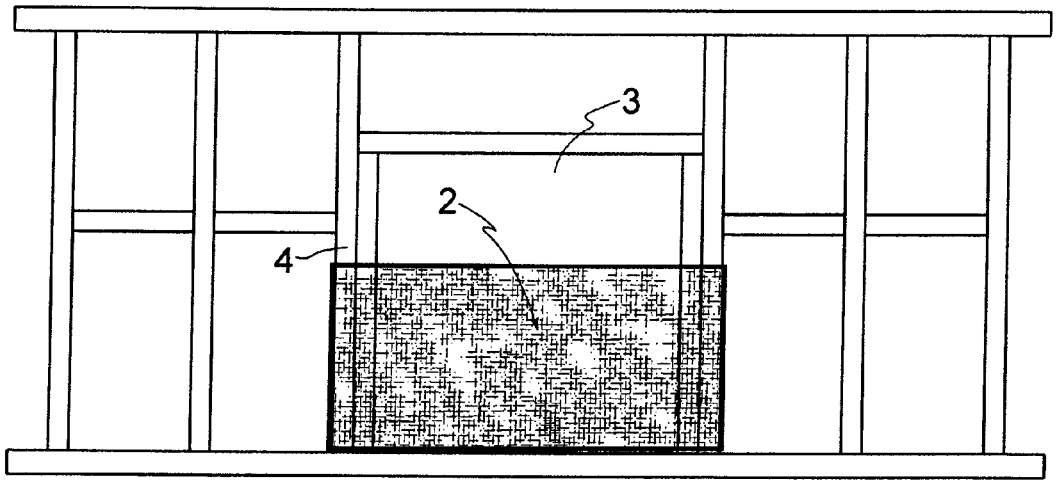
FIG. 1 shows, schematically, part of a wall frame having an opening with temporary protection in accordance with the preferred embodiment of the invention.
Figure 2:
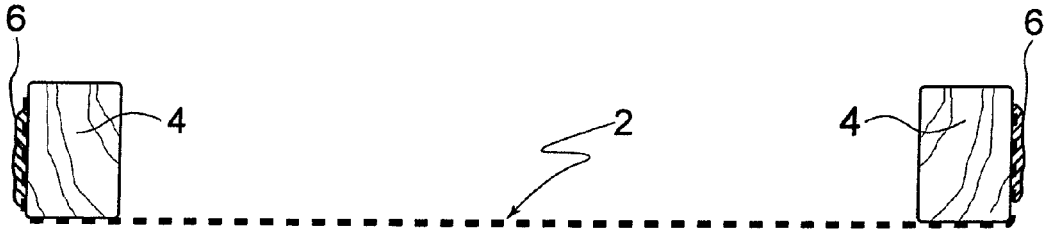
FIG. 2 is a section showing schematically how the sheet material is attached to studs of the wall frame at each side of an opening.
Figure 3:
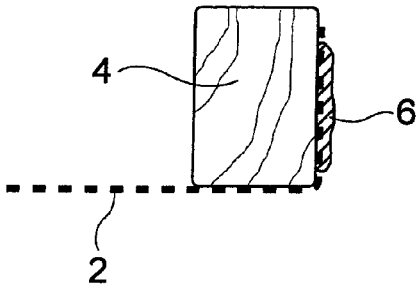
FIG. 3 is an enlarged detail of FIG. 2.

We have determined that a satisfactory adhesive connection can be best achieved by using a strong fabric with a relatively open weave, a flexible mesh-type material, a woven mesh for example, or perforated sheet material whereby when the material is applied at its inner face to a thick layer of adhesive on the face of the stud, adhesive will extrude through the interstices of the material to lie also on the outer face of the material as shown schematically in FIG. 3 in which the adhesive is designated at 6. This will be observable to the person making the connection to ensure that the adhesive bond is at the inner and outer faces of the material via its interstices, and is continuous along the entire width of the material; accordingly checks can easily be put into place to establish that the process has been carried out correctly. By way of example, suitable materials include certain types of shade cloth and strong flexible mesh materials of the type commonly used for insect screens and constructed of woven glass fibres.

Figure 4:
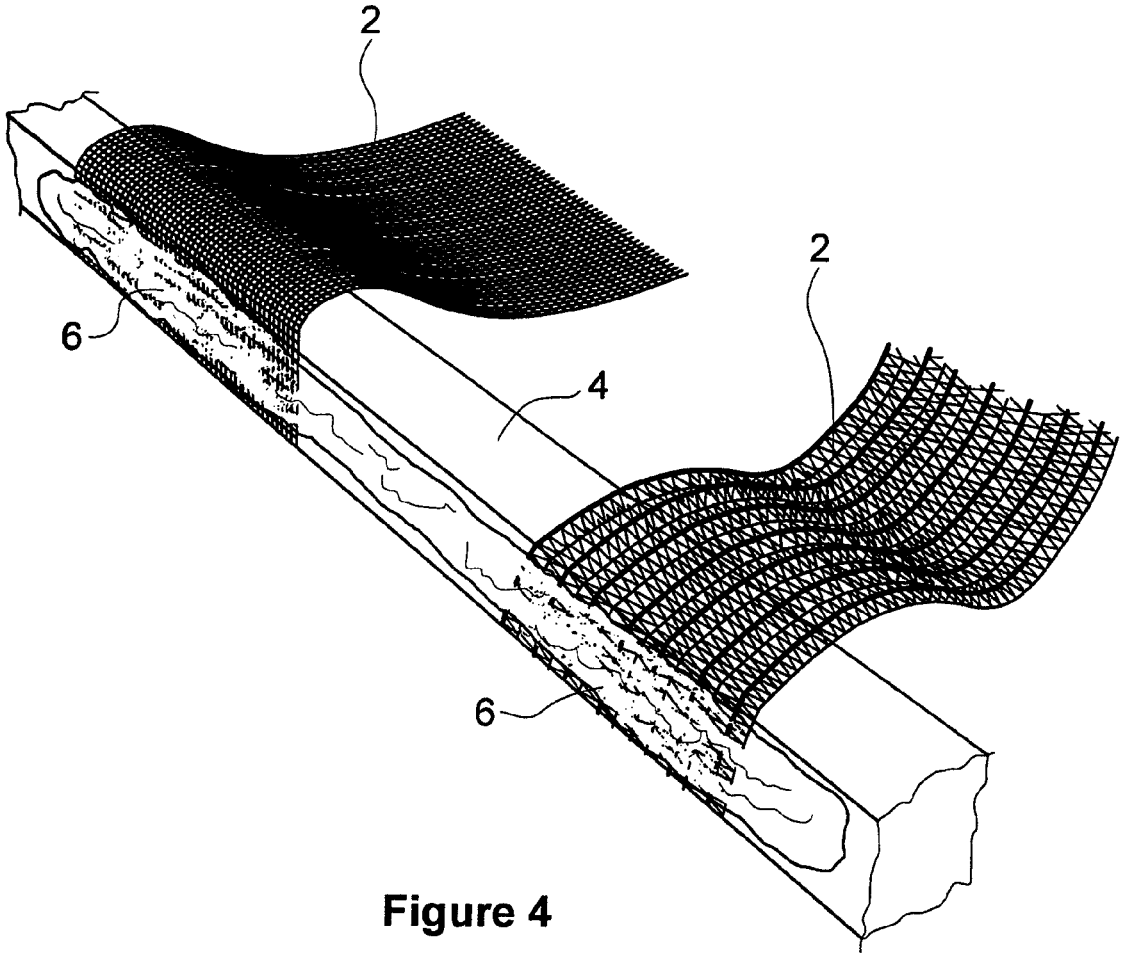
FIG. 4 illustrates how a satisfactory adhesive connection can be achieved with different types of sheet material.

FIG. 4 illustrates in detail how the adhesive connection to the stud can be achieved with both a mesh used for insect screens and a shade cloth of open weave.

It is envisaged that the invention has applicability for use with prefabricated wall frames made in a factory situation, rather than wall frames fabricated onsite, to ensure a proper quality control. Typically, the material will be supplied in roll form with the requisite length being unwound from the roll to the required length and then applied to the openings in the manner described prior to delivery on site.

Although when in place, the material 2 will extend across the inner face of the opening, the material does not have substantial thickness and will be insufficient to interfere with the installation of plasterboard to the inside of the wall frame. When the opening is to be revealed for installation of the window or door, the material can be removed by cutting along its width close to the stud by means of a sharp knife. Although the adhesively connected edge portion of the material will still remain, as it is at the remote side face of the stud it will not interfere with subsequent installation of components. In principle it would be possible for the material to be connected to the outer face of the stud whereby it passes around two corners of the stud before passing across the inside face of the stud and the opening whereby further load dissipation would be achieved by the second corner but it is believed that in most cases connection to the remote side face and passage around a single corner will suffice and that is the preferred arrangement.

Although the preferred embodiment has been described in relation to protecting an opening in a wall frame, the invention has broader applicability than that. It is applicable to a wide range of building components having an opening for which temporary protection of the type discussed is required during erection of a building structure; without limitation, examples include door frames or window frames as may typically be prefabricated in a factory situation to be installed into other building structure on site such as framework being built on site rather than prefabricated.

The embodiment has been described by way of example only and modifications are possible within the scope of the invention.

The inventioned claimed is:

1. A temporary safety barrier for an opening in a building component, the barrier comprising:

at least two opposite vertical support members in a static wall structure framing an opening therebetween; and a flexible sheet material having a length, a width, an inner surface and an outer surface, the flexible sheet material being disposed between the at least two opposite vertical support members and wrapped around at least one corner of each of the opposite vertical support members, thereby spanning the entire width and a portion of the height of the opening, wherein the flexible sheet material is adhesively secured against each of the vertical support members across a substantially entire surface of the sheet material that is in contact with a side of each of the vertical support members perpendicular to the opening and opposite to the opening.

2. A temporary safety barrier for an opening in a building component as claimed in claim 1, wherein the flexible sheet material is adhesively secured such that the adhesive extends across and permeates through the flexible sheet material to ensure load distribution across the entire surface of the sheet material in contact with the vertical support members.

3. A temporary safety barrier for an opening in a building component as claimed in claim 1, including at least two opposed horizontal bracing members of rectangular section, wherein the flexible sheet material is applied vertically across the opening between opposed horizontal bracing members.

4. A method of providing a temporary safety barrier for an opening during building construction, comprising the steps of:

applying an adhesive to a first side face of a first structural support member in a static wall structure that borders the opening, wherein the first side face is the farthest side face of the first support member from the opening and the plane of the first side face is perpendicular to the plane of the opening;

applying an adhesive to a second side face of a second structural support member that borders the opening, wherein:

the second structural support member is opposite to the first structural support member;

the second side face is the farthest side face of the second support member from the opening; and the plane of the second side face is perpendicular to the plane of the opening;

wrapping a first end of a flexible sheet material around a corner of the first structural support member that is adjacent to the adhesive first side face, wherein the flexible sheet material has a length, a width, an inner surface, an outer surface and a resistance to tensile loading; and wrapping a second end of the flexible sheet material around a corner of the second structural support member that is adjacent to the adhesive second side face of the second structural member, wherein the second end is opposed to the first end of the flexible sheet material, thereby spanning the opening by means of the flexible sheet material.

5. The method of providing a temporary safety barrier for an opening during building construction as claimed in claim 4, wherein the adhesive permeates through the flexible sheet material and lies on the outer surface of the material.

6. The method of providing a temporary safety barrier for an opening during building construction as claimed in claim 4, wherein the structural support members are rectangular vertical support members.

* * * * *